US007238908B1

(12) United States Patent
Chen

(10) Patent No.: US 7,238,908 B1
(45) Date of Patent: Jul. 3, 2007

(54) KEY STRUCTURE OF KEYBOARD

(75) Inventor: Peter Chen, Taipei County (TW)

(73) Assignee: Key Mouse Electronic Enterprise Co., Ltd., Sinjhuang (TW)

( * ) Notice: Subject to any disclaimer, the term of this patent is extended or adjusted under 35 U.S.C. 154(b) by 0 days.

(21) Appl. No.: 11/489,598

(22) Filed: Jul. 20, 2006

(51) Int. Cl.
*H01H 13/70* (2006.01)

(52) U.S. Cl. ..... 200/344

(58) Field of Classification Search ..... 200/5 A, 200/517, 344, 345, 341; 400/490–496; 341/22; 345/168, 169, 172
See application file for complete search history.

(56) References Cited

U.S. PATENT DOCUMENTS 5,947,616 A * 9/1999 Liang ..... 200/344
6,183,150 B1 * 2/2001 Kao ..... 200/344
6,376,789 B2 * 4/2002 Maruyama et al. ..... 200/344
6,504,121 B2 * 1/2003 Hasunuma ..... 200/344
6,538,222 B2 * 3/2003 Hsu ..... 200/344
6,545,232 B1 * 4/2003 Huo-Lu ..... 200/344
6,909,062 B2 * 6/2005 Narusawa et al. ..... 200/344
6,958,458 B1 * 10/2005 Tsai ..... 200/344

* cited by examiner

*Primary Examiner*—Michael A. Friedhofer
(74) *Attorney, Agent, or Firm*—Birch, Stewart, Kolasch & Birch, LLP

(57) ABSTRACT

A key mounted in a keyboard includes a key cap including a peg; a base plate including a central first opening a U-shaped first pivot frame including a pivot shaft at its interconnection portion pivotably secured to the base plate, and two end pins pivotably secured to the key cap; a rectangular second pivot frame including a pivot shaft at one end pivotably secured to the base plate, a central second opening, and two arms at the other end pivotably secured to the key cap; a hollow resilient member inserted through the first opening and including a conductive stem; a membrane PCB with the resilient member mounted thereon. A scissor-type resilient support is formed by the crossed first and second pivot frames with the resilient member inserted through the second opening and the peg aligned with the stem.

6 Claims, 18 Drawing Sheets

KEY STRUCTURE OF KEYBOARD

BACKGROUND OF THE INVENTION

1. Field of Invention

The present invention relates to key structure of keyboard and more particularly to a key structure of a computer keyboard or a key pad of any of other electronic devices with improved characteristics.

2. Related Art

A conventional process of assembling a base of a key of a computer keyboard is illustrated in FIGS. 1*a* to 1*d*. As shown, the process involves steps of pushing one U-shaped pivot frame onto a top of a base plate to have its two ends pivotably secured to two positioning points of the base plate (see FIG. 1*a*); and pivotably pushing down the interconnection portion of the pivot frame onto the top of the base plate (see FIGS. 1*b* and 1*c*). A finished base of the keyboard is shown in FIG. 1*d*.

However, the prior art process suffered from several disadvantages. For example, it is complicated and labor intensive. Further, its assembly cost is very high. Thus, the need for improvement still exists.

SUMMARY OF THE INVENTION

It is therefore an object of the present invention to provide a key structure of a keyboard having the advantages of increased structural strength, simply and easy assembly, durability, being labor saving, and cost effective.

To achieve the above and other objects, the present invention provides a key mountable in a keyboard comprising a base plate including a rectangular top cavity, a central first opening through the cavity, two first catch members on two corners of the cavity at one end and each including a first guide slope on its side surface, two wells on the other two corners of the cavity at the other end, two ribs on one side of the cavity proximate the first catch members, a riser between the ribs, and two second catch members on the other two corners of the cavity at the other end proximate the wells and each including a second guide slope on its side surface; a U-shaped first pivot frame including a projecting first pivot shaft parallel to its interconnection portion, two pins at both ends, two side first pivots, and two projecting stop members on a bottom adjacent the pins; a rectangular second pivot frame including a projecting second pivot shaft at one end, two side second pivots, a central second opening, and two arms at the other end inwardly extending toward each other; a hollow resilient member inserted through the first opening and including a conductive stem extending downward from its top; a key cap including a central peg extending downward from its underside; and a membrane PCB with the resilient member mounted thereon; wherein the second pivot shaft is mounted between the first catch members and the cavity by snapping through the first guide slopes and the riser such that the second pivot frame is adapted to pivot about the second pivot shaft relative to the base plate; the pins are mounted between the second catch members and the cavity by snapping through the second guide slopes with the stop members inserted into the wells such that the first pivot frame is adapted to pivot about the pins relative to the base plate; the first and second pivots are matingly formed together such that the first and second pivot frames are adapted to form a scissor-type resilient support; the first pivot shaft is rotatably secured to the underside of the key cap; and the arms are rotatably secured to the underside of the key cap with the resilient member inserted through the second opening and the peg aligned with the stem.

In one aspect of the present invention the first pivot is a hole and the second pivot is a pin.

In another aspect of the present invention the resilient member is formed of silicon rubber and is shaped as a dome.

In a further aspect of the present invention a panel is provided with the membrane PCB mounted thereon.

The above and other objects, features and advantages of the present invention will become apparent from the following detailed description taken with the accompanying drawings.

DETAILED DESCRIPTION OF THE INVENTION

Figure 1A:
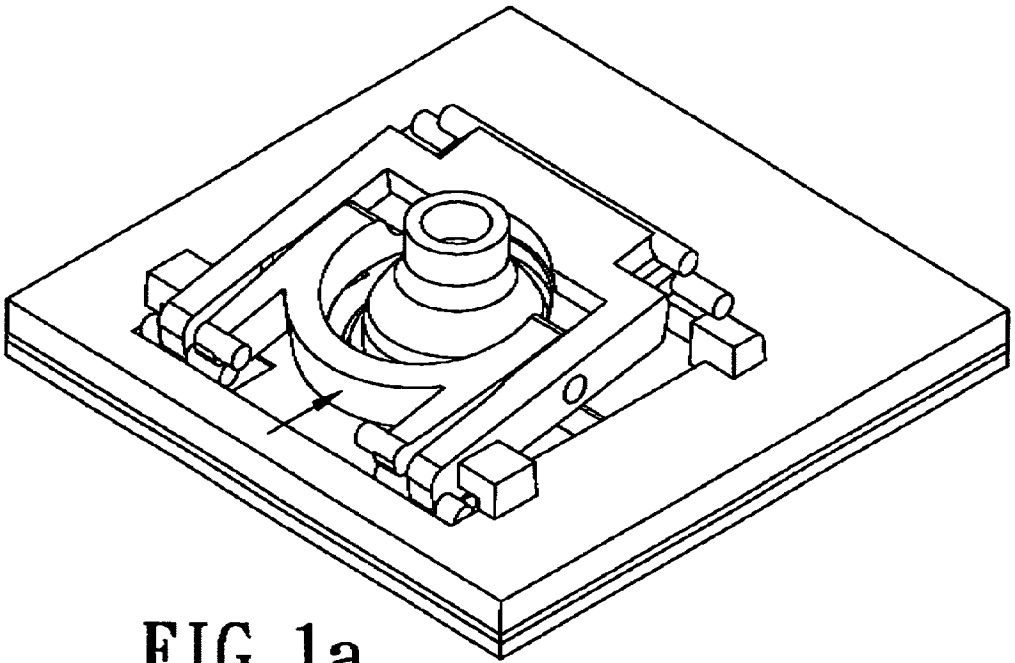
FIG. 1a PRIOR ART
FIGS. 1*a*, 1*b*, 1*c*, and 1*d* are perspective views for illustrating steps of a conventional process of assembling a base of key of a computer keyboard.
Figure 1B:
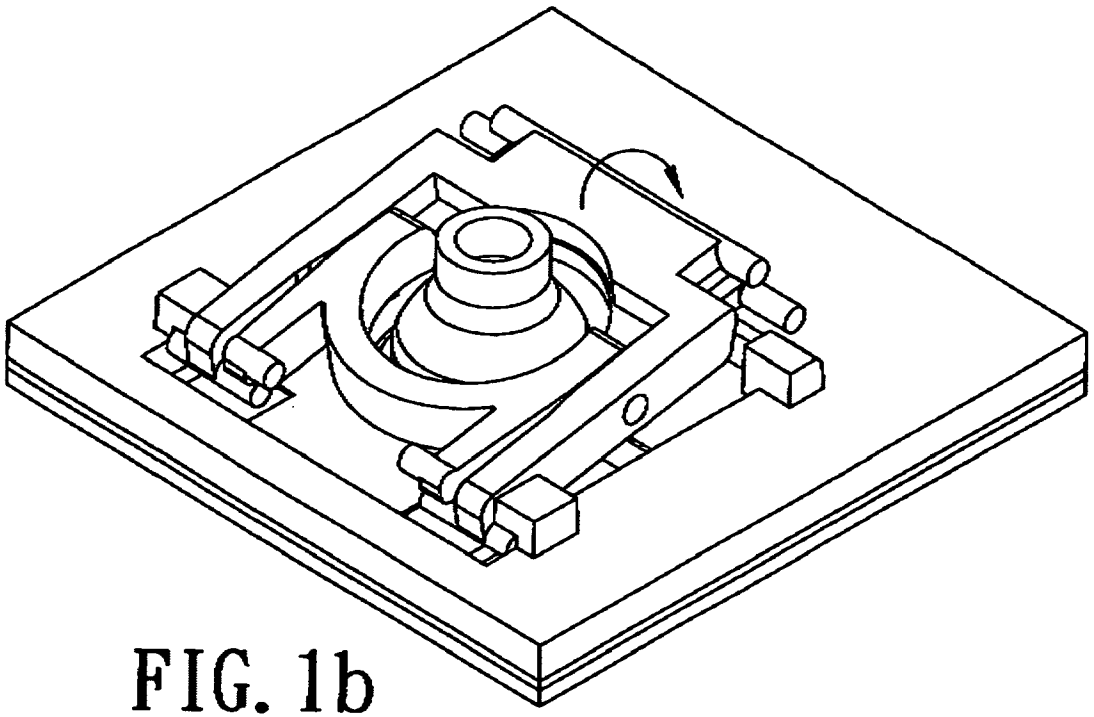
FIG. 1b PRIOR ART
Figure 1C:
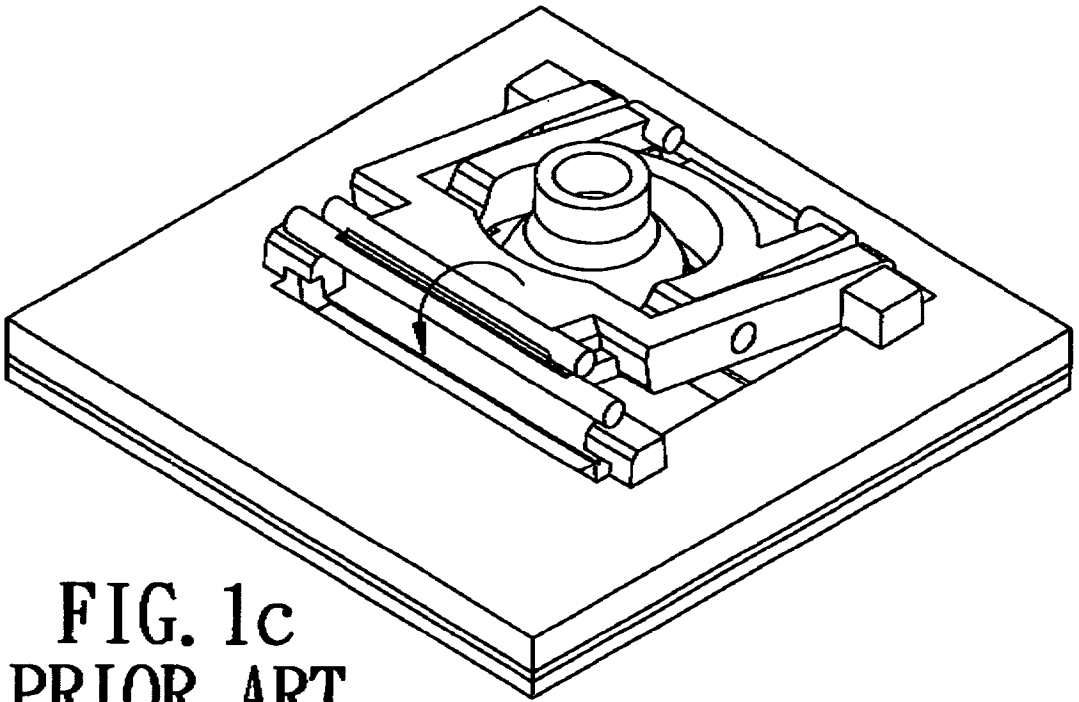
FIG. 1c PRIOR ART
Figure 1D:
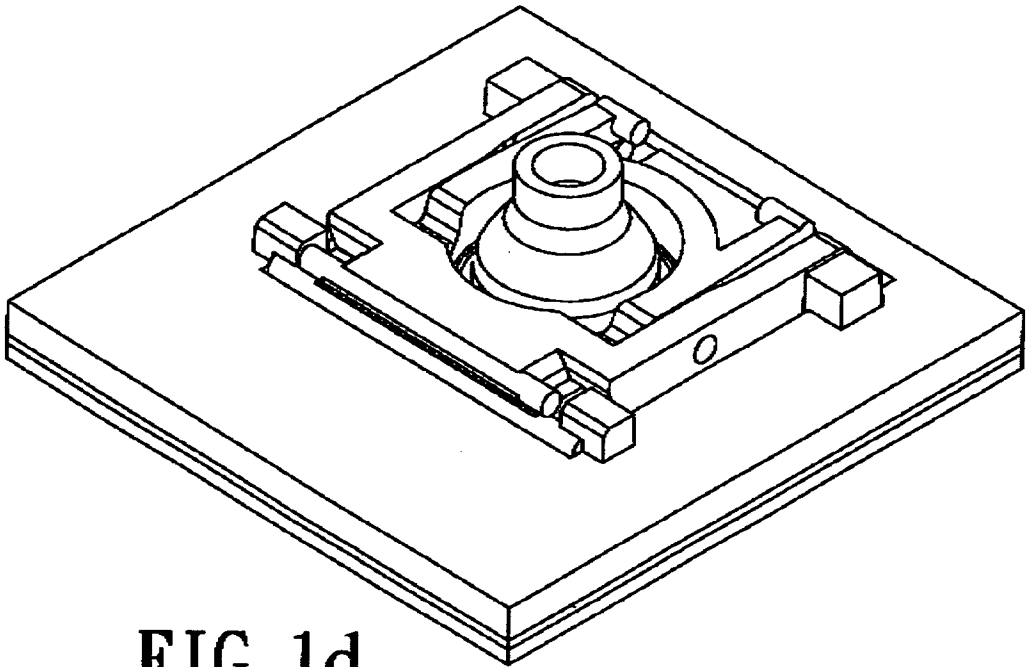
FIG. 1d PRIOR ART
Figure 2:
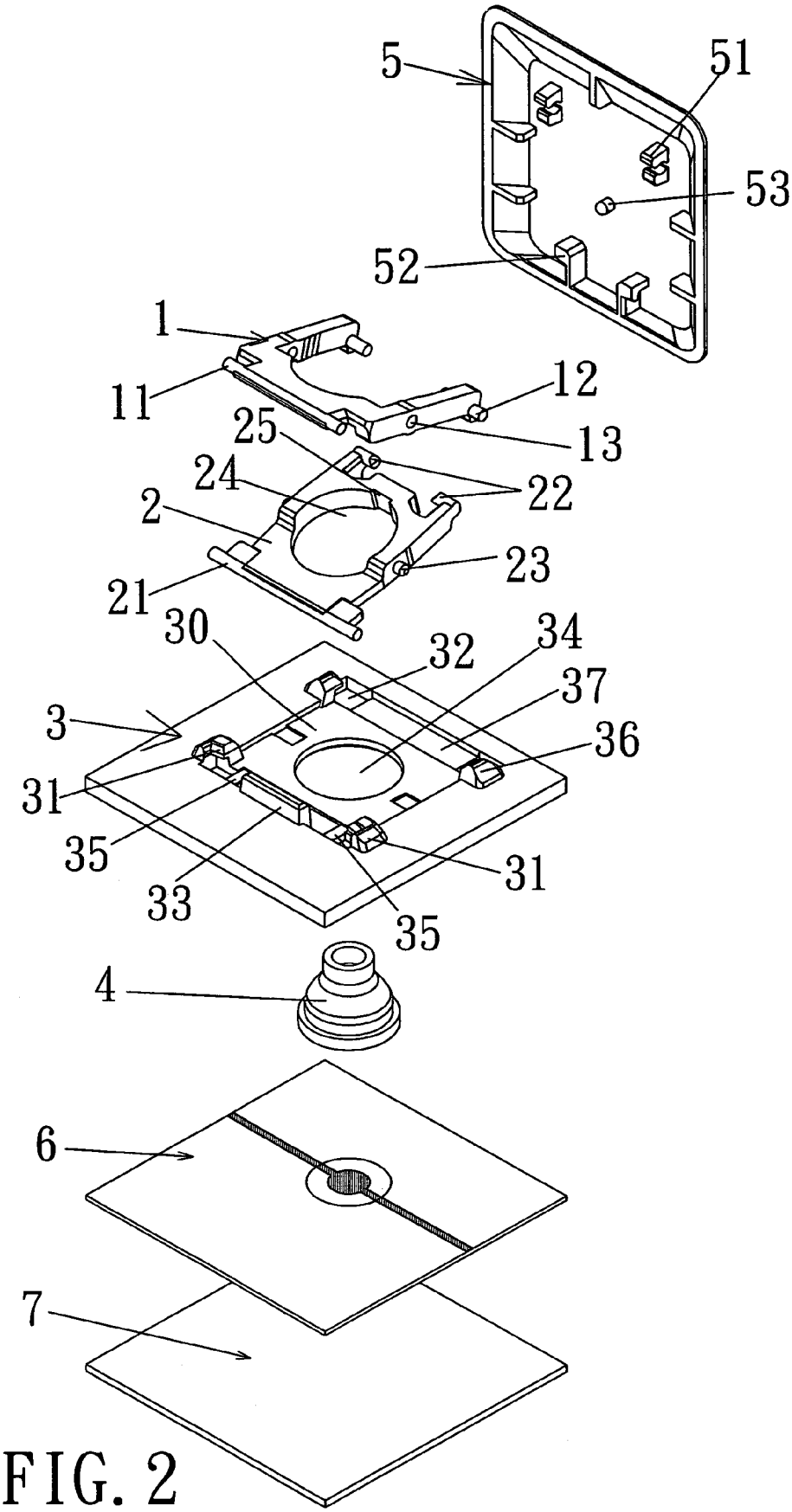
FIG. 2 is an exploded view of a preferred embodiment of key assembly of a keyboard according to the invention.
Figure 2A:
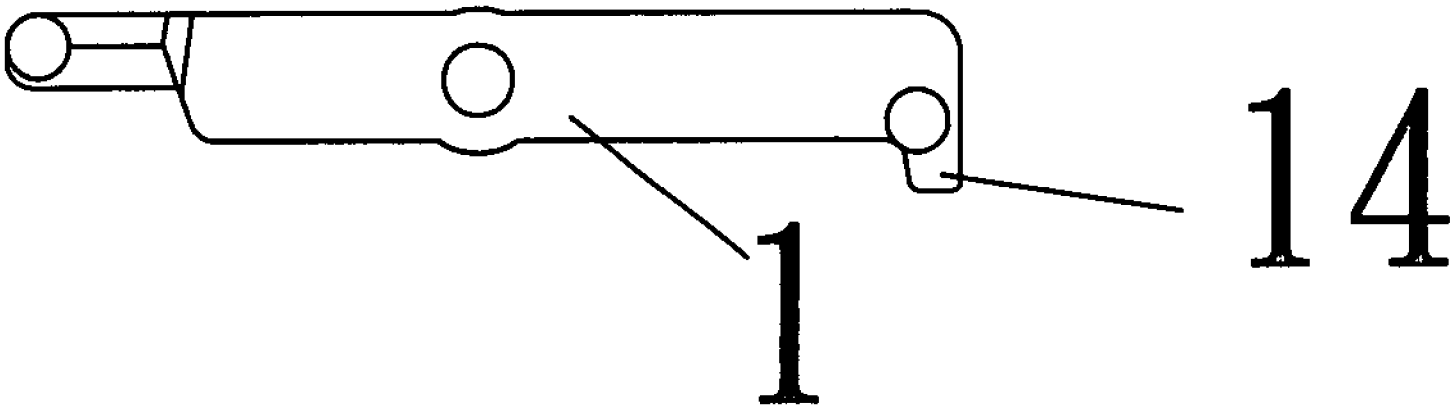
FIG. 2*a* is a side elevation of the first pivot frame.
Figure 3:
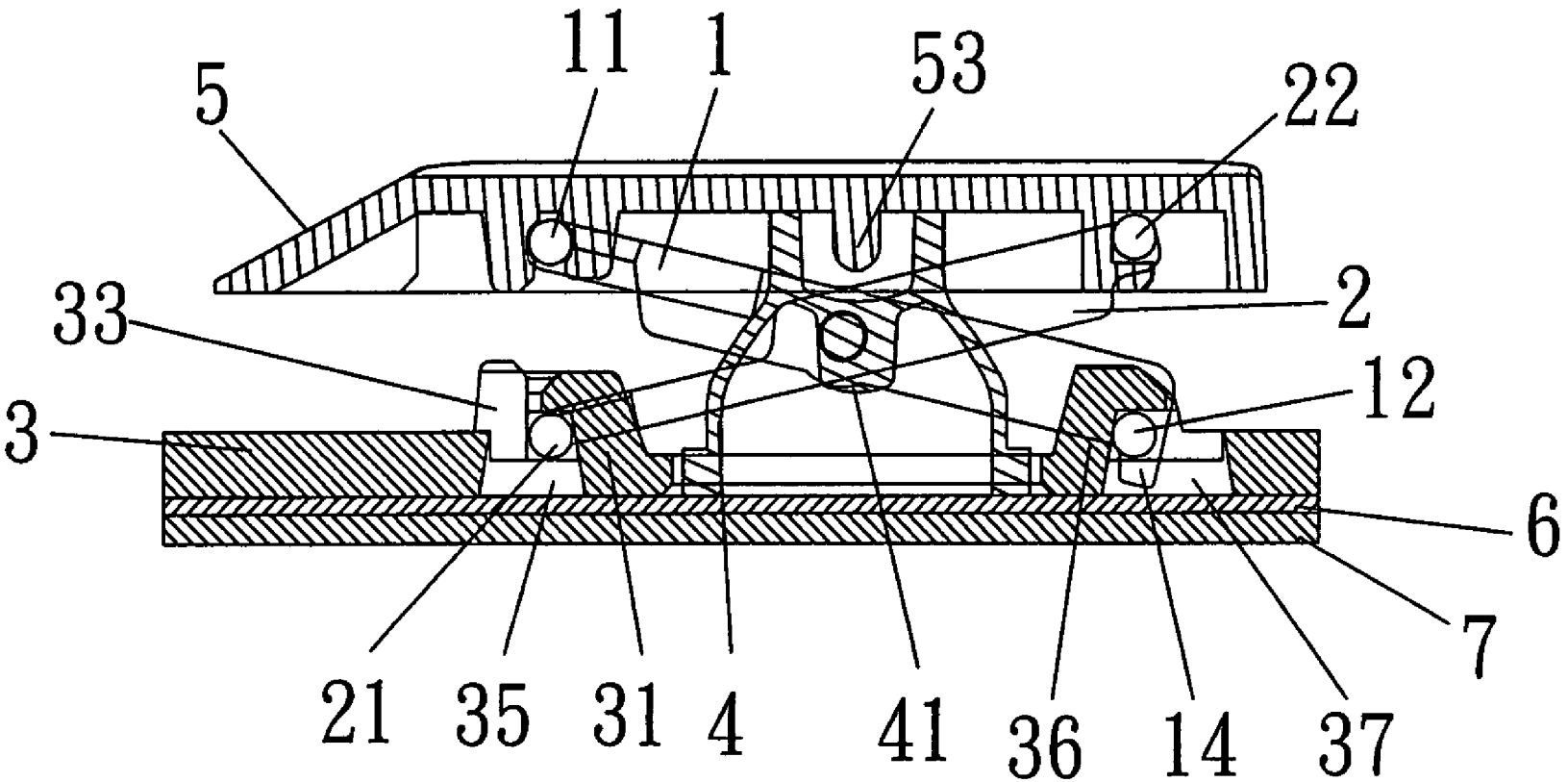
FIG. 3 is a longitudinal sectional view of the assembled key assembly where the key cap is disposed above the base plate by a predetermined distance when the key cap is not depressed.
Figure 4:
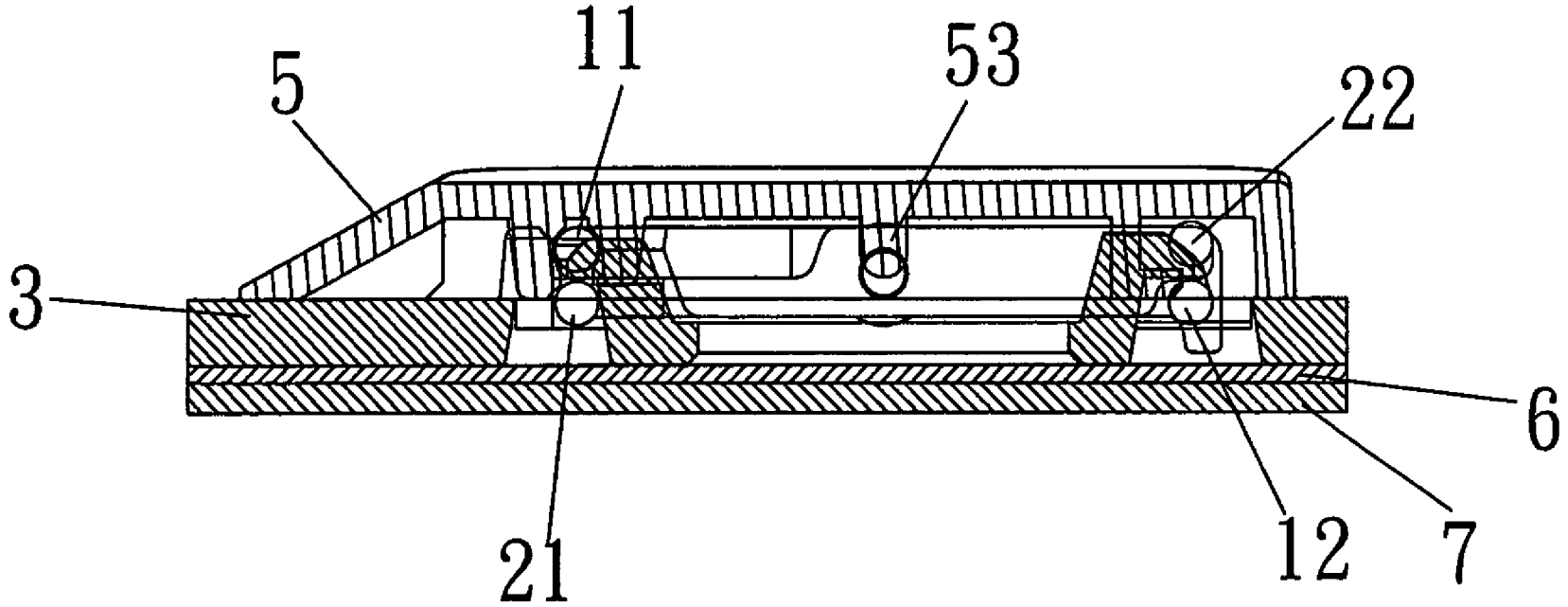
FIG. 4 is a view similar to FIG. 3 when the key cap is depressed.
Figure 5:
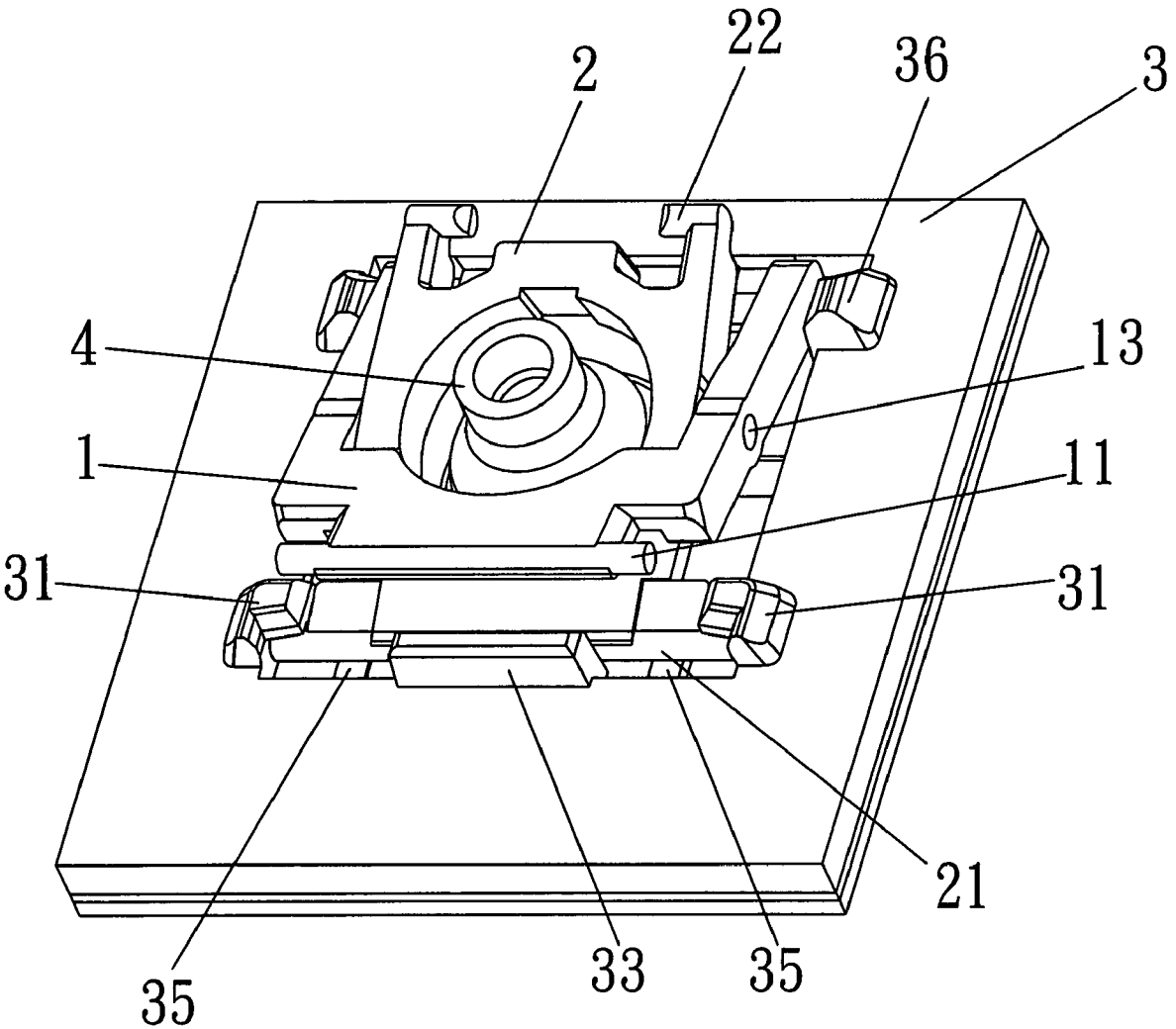
FIG. 5 is a perspective view of the assembled key assembly of FIG. 2 with the key cap removed.
Figure 6:
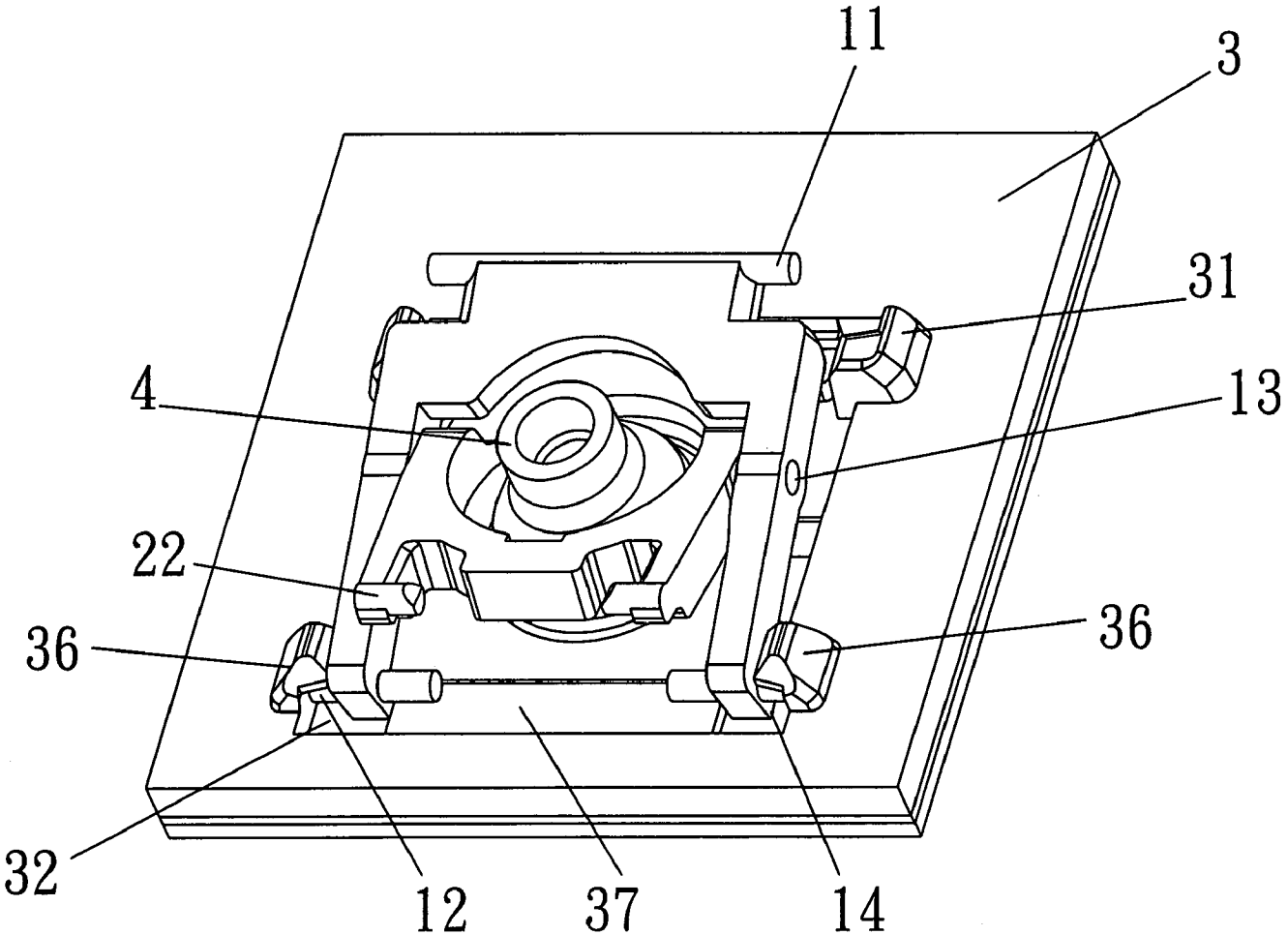
FIG. 6 is a view similar to FIG. 5 but viewed from an opposite angle from its top.
Figure 7:
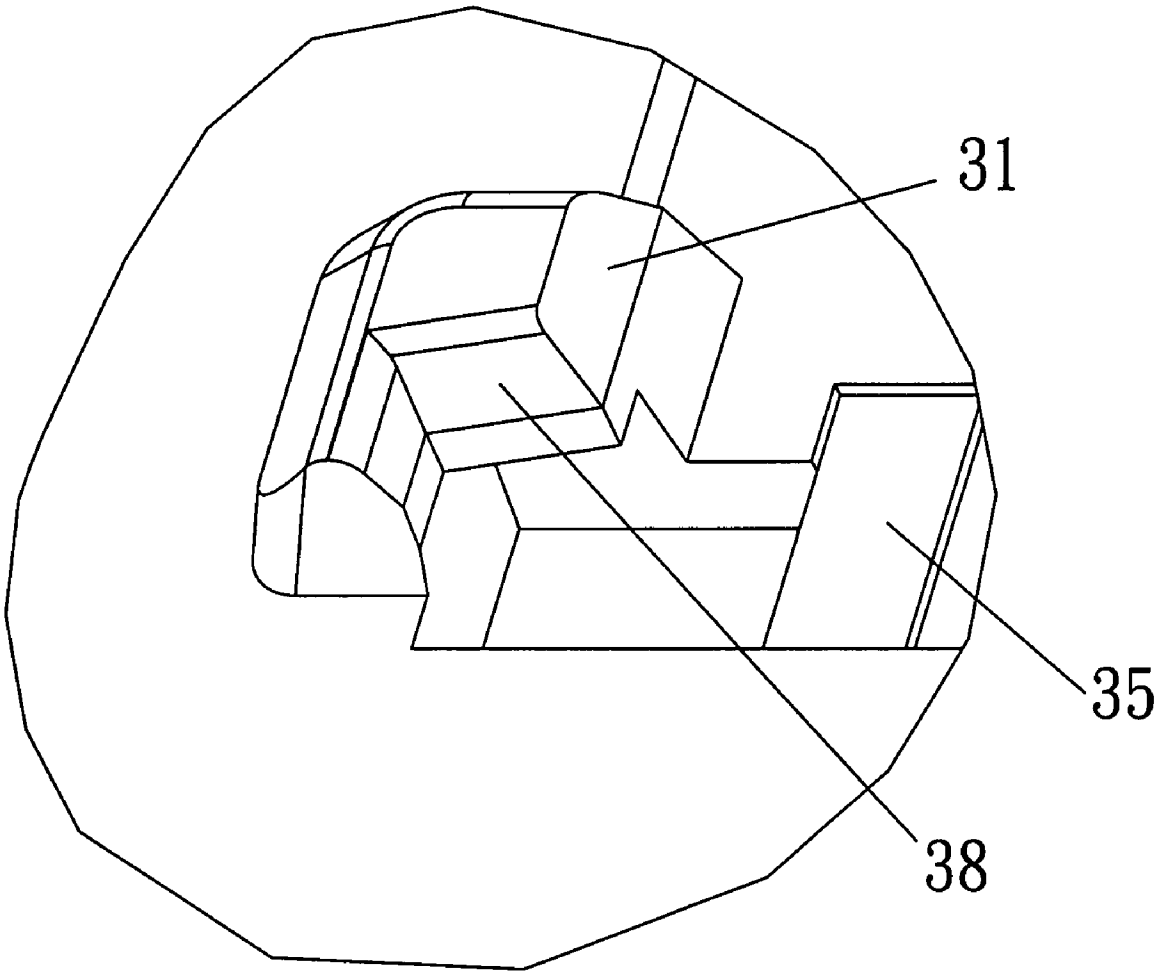
FIG. 7 is a greatly enlarged view for showing the assembled first catch member of the base plate and the first guide slope of the first catch member.
Figure 8:
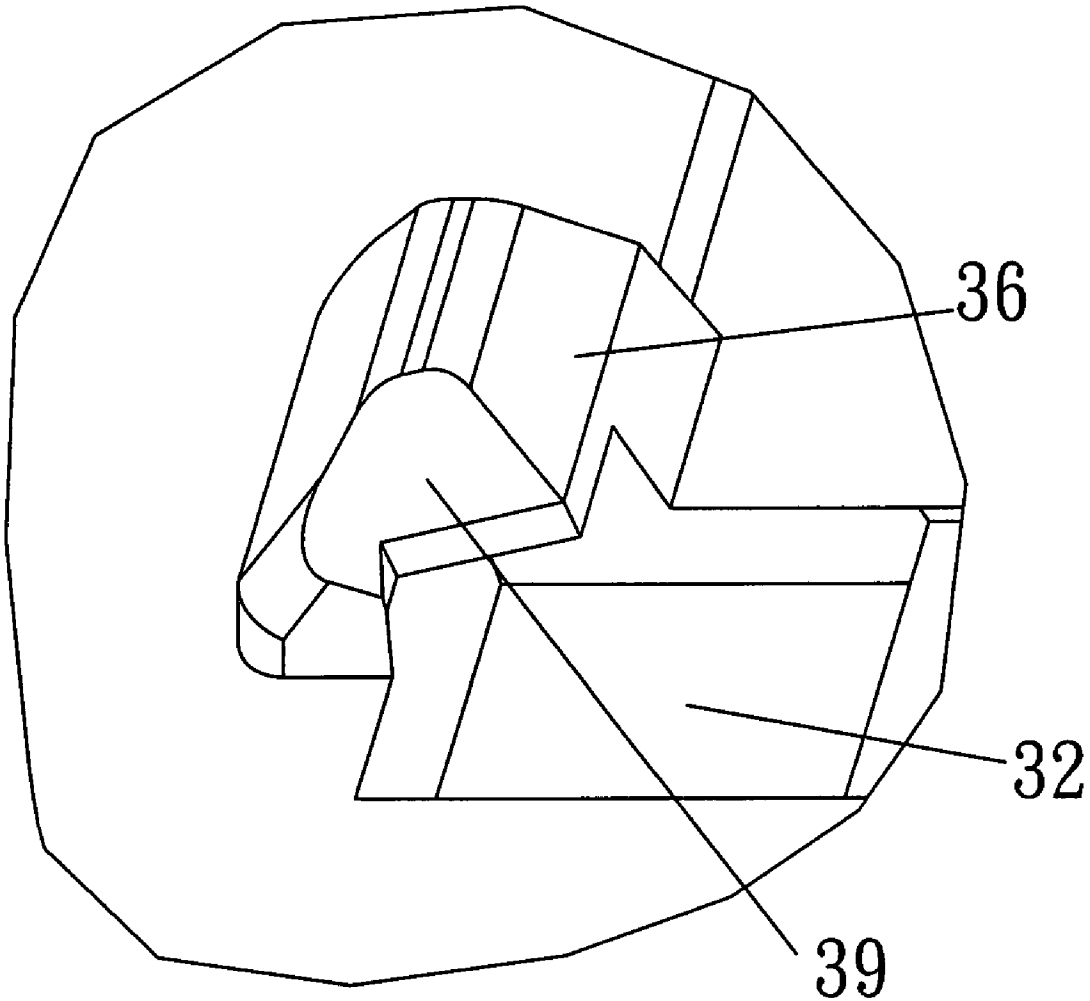
FIG. 8 is a greatly enlarged view for showing the assembled second catch member of the base plate and the second guide slope of the second catch member.
Figure 9A:
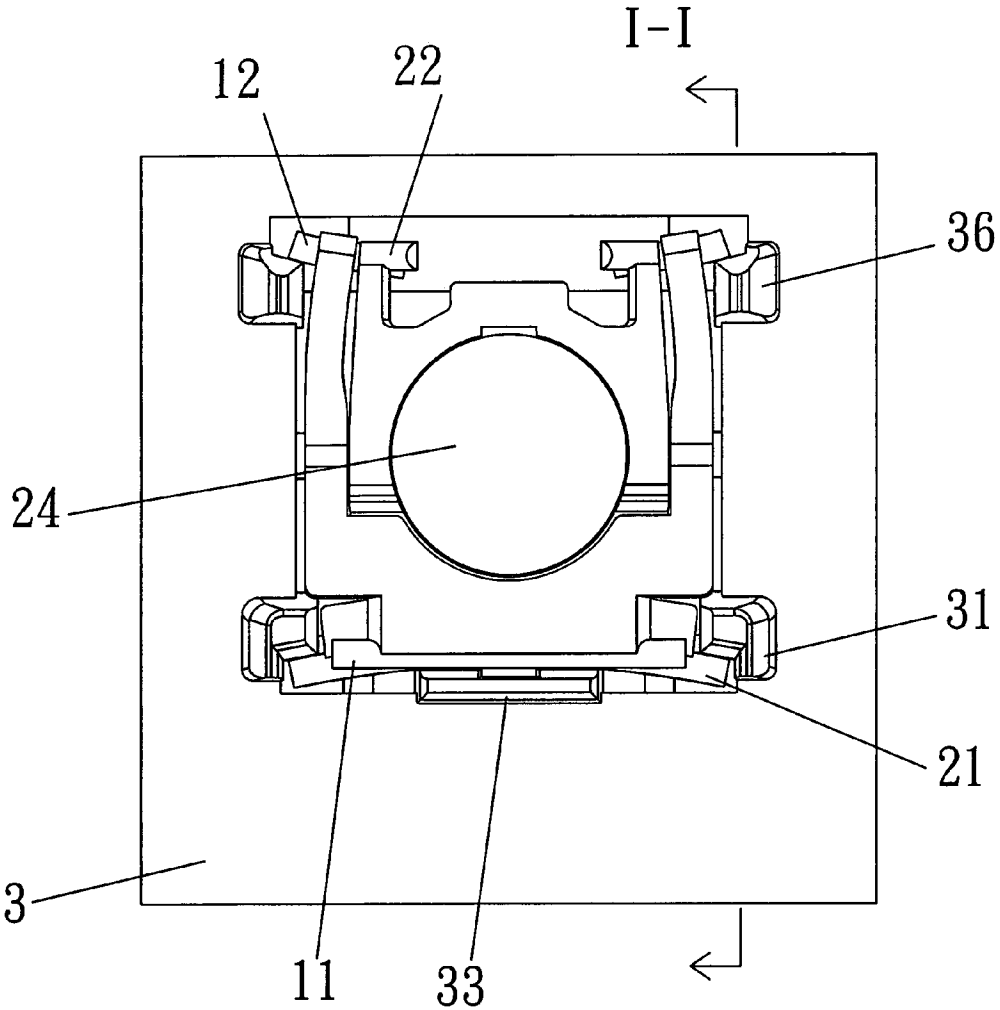
FIG. 9*a* is a top plan view of the pivot frames and the base plate being assembled.
Figure 9B:
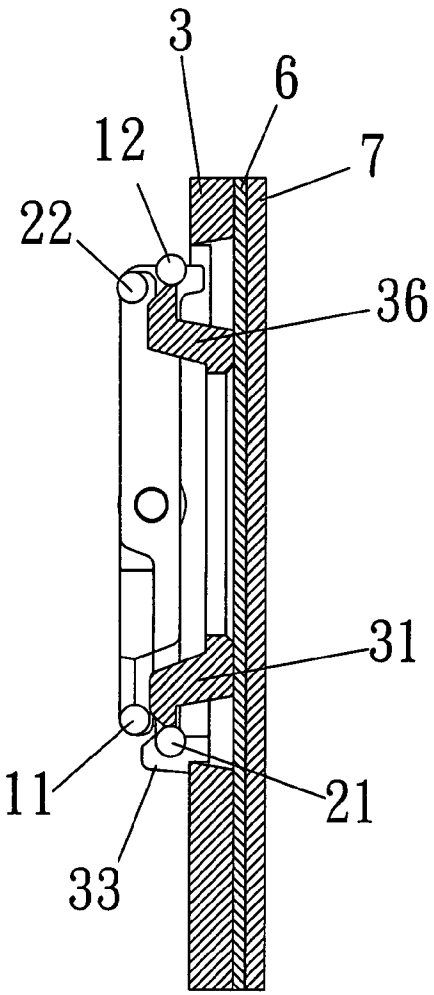
FIG. 9*b* is a sectional view taken along line I—I of FIG. 9*a;*
Figure 9C:
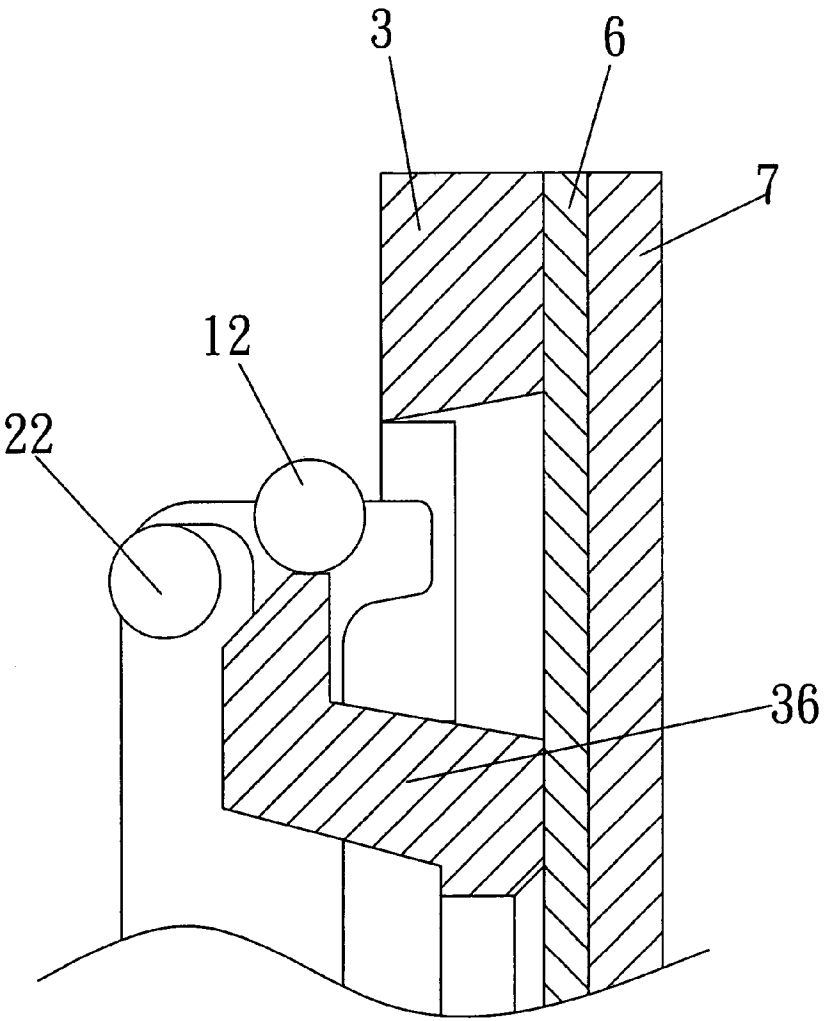
FIG. 9*c* is a greatly enlarged view of the upper portion of FIG. 9*b;*
Figure 10A:
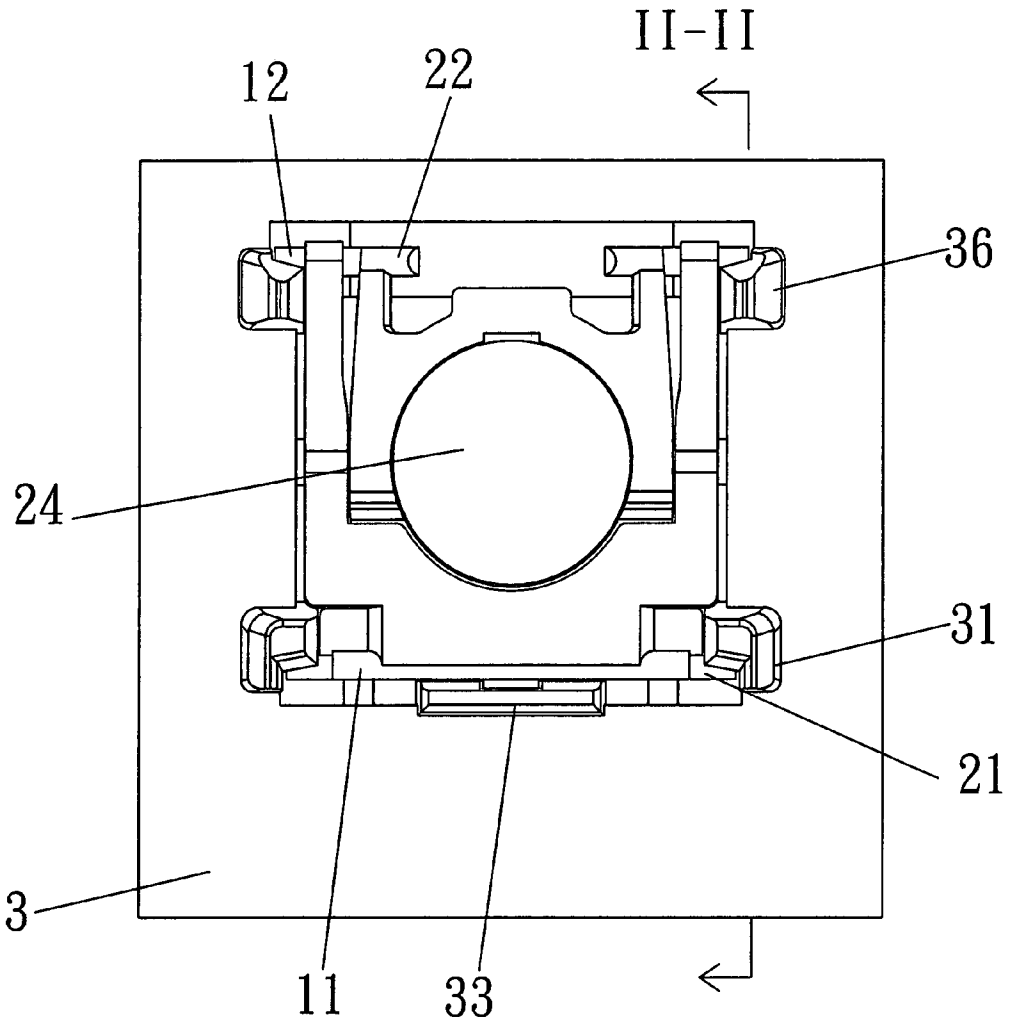
FIG. 10*a* is a top plan view of the assembled the pivot frames and the base plate.
Figure 10B:
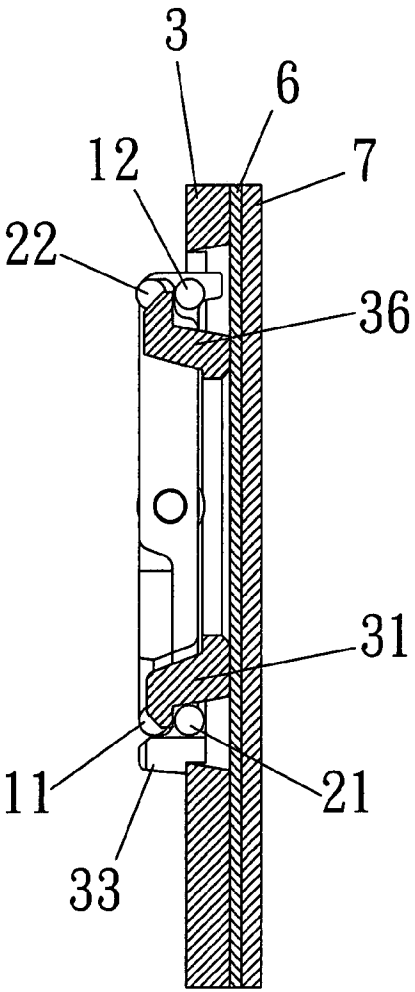
FIG. 10*b* is a sectional view taken along line I—I of FIG. 1*a*.
Figure 10C:
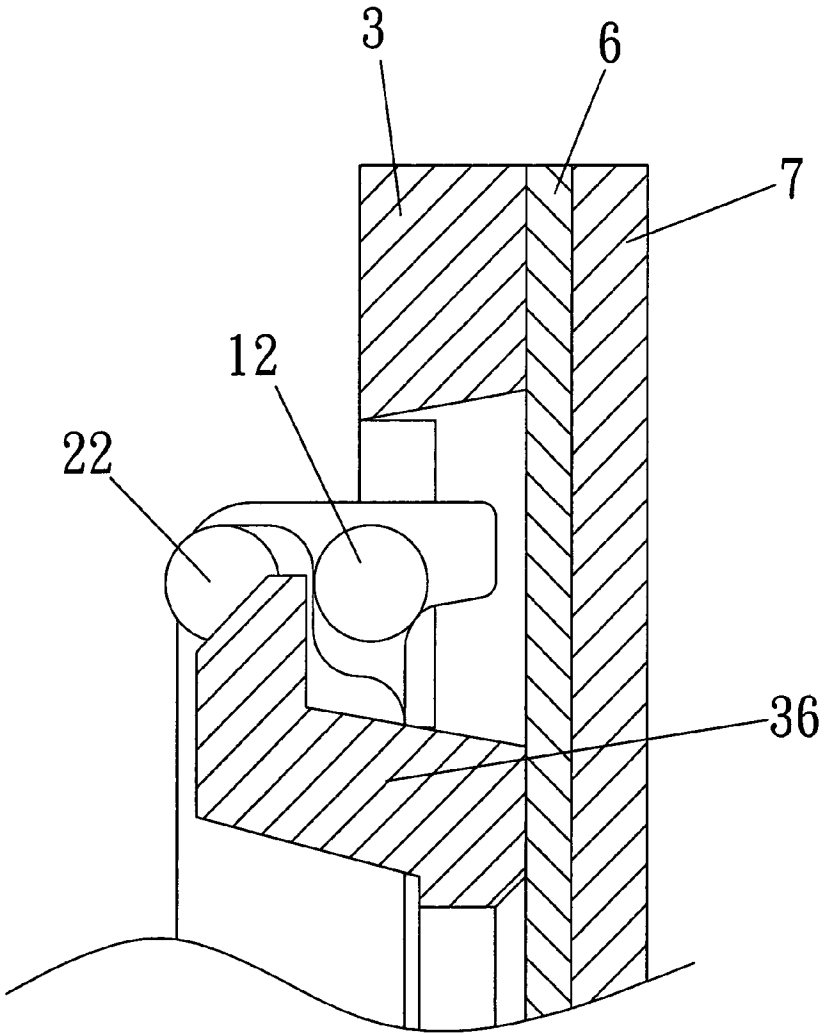
FIG. 10*c* is a greatly enlarged view of the upper portion of FIG. 10*b*.

Referring to FIGS. 2 to 10*c*, a key assembly of a keyboard in accordance with a preferred embodiment of the invention is shown. The key assembly can be one of a plurality of keys mounted in a computer keyboard or a key pad of any of other electronic devices. The key assembly comprises a key cap 5, a base plate 3, first and second pivot frames 1 and 2, a resilient member 4, a PCB (printed circuit board) 6 in the form of a square membrane, and a panel 7. Each component is discussed in detailed below.

The first pivot frame 1 is in a U shape and comprises a projecting pivot shaft 11 parallel to its interconnection portion, two bar-shaped pins 12 at both ends, two side holes 13 each provided between the interconnection portion and either pin 12, and two projecting stop members 14 on a bottom adjacent the pins 12.

The second pivot frame 2 is rectangular and comprises a projecting pivot shaft 21 at one end, two side pins 23, a central opening 24, a positioning recess 25 on the wall of the opening 24, and two arms 22 at the other end inwardly extending toward each other.

The base plate 3 is a square and comprises a square cavity 30 on its top, a central opening 34 through the cavity 30, two first catch members 31 on two corners of the cavity 30 at one end and each including a first guide slope 38 on its side surface, two wells 32 on the other two corners of the cavity 30 at the other end, two ribs 35 on one side of the cavity 30 proximate the first catch members 31, a riser 33 between the ribs 35, two second catch members 36 on the other two corners of the cavity 30 at the other end proximate the wells 32 and each including a second guide slope 39 on its side surface, and a rectangular support 37 between the wells 32.

The resilient member 4 is formed of silicon rubber and is shaped as a hollow dome. The resilient member 4 comprises a top aperture and a conductive stem 41 extending downward from its top. The key cap 5 is square and comprises, on its underside, two spaced bifurcations 51 aligned with one side, two L-shaped latches 52 inwardly projecting from the other opposing side, and a central peg 53.

An assembly of the invention will be described in detailed below. Place the PCB 6 on the panel 7 and secure them together by applying adhesive there between. Next, mount the resilient member 4 on a predetermined location of the PCB 6 (e.g., around a surface contact of the PCB 6). Next, mount the base plate 3 on the PCB 6 by inserting the resilient member 4 through the opening 34 until being stopped. Next, mount the pivot shaft 21 between the first catch members 31 and the cavity 30 by snapping through the first guide slopes 38 and the riser 33 with the resilient member 4 inserted through the central opening 24. As a result, the second pivot frame 2 is adapted to pivot about the pivot shaft 21 relative to the base plate 3. Note that the provision of the ribs 35 can decrease rotational friction of the pivot shaft 21. Next, mount the pins 12 between the second catch members 36 and the cavity 30 by snapping through the second guide slopes 39 with the stop members 14 inserted into the wells 32. As a result, the first pivot frame 1 is adapted to smoothly, securely pivot about a virtual axis through the pins 12 relative to the base plate 3. Also, insert the pins 23 into the holes 13 to form two pivots. As a result, a scissor-type resilient support member is formed by the first and second pivot frames 1 and 2 because the first pivot frame 1 is adapted to pivot about a virtual axis through the pins 23 relative to the second pivot frame 2 and vice versa. Next, insert the pivot shaft 11 into the bifurcations 51 in place. As a result, the bifurcations 51 and the pivot shaft 11 are pivotably secured together. Next, mount the arms 22 in the latches 52. As a result, the arms 22 and the latches 52 are pivotably secured together with the peg 53 vertically aligned with the stem 41. The peg 53 is disposed above the stem 41 by a predetermined distance. A secure, reliable key assembly is thus finished.

It is understood that in a key typing operation pressing the key cap 5 will cause the peg 53 to pass the top aperture of the resilient member 4 to press the stem 41 by elastically deforming the resilient member 4. As an end, the stem 41 contacts the contact of the PCB 6 for electrical connection.

While the invention herein disclosed has been described by means of specific embodiments, numerous modifications and variations could be made thereto by those skilled in the art without departing from the scope and spirit of the invention set forth in the claims.

What is claimed is:

1. A key mountable in a keyboard comprising:

a base plate including a rectangular top cavity, a central first opening through the cavity, two first catch members on two corners of the cavity at one end and each of the catch members including a first guide slope on a side surface, two wells on an other two corners of the cavity at an other end, two ribs on one side of the cavity proximate the first catch members, a riser between the ribs, and two second catch members on the other two corners of the cavity at the other end proximate the wells and each of the second catch members including a second guide slope on a side surface;

a U-shaped first pivot frame including a projecting first pivot shaft parallel to an interconnection portion, two pins at both ends, two side first pivots, and two projecting stop members on a bottom adjacent the pins;

a rectangular second pivot frame including a projecting second pivot shaft at one end, two side second pivots, a central second opening, and two arms at the other end inwardly extending toward each other;

a hollow resilient member inserted through the first opening and including a conductive stem extending downward from the top;

a key cap including a central peg extending downward from the underside; and a membrane PCB with the resilient member mounted thereon; wherein the second pivot shaft is mounted between the first catch members and the cavity by snapping through the first guide slopes and the riser such that the second pivot frame is pivotable about the second pivot shaft relative to the base plate;

the pins are mounted between the second catch members and the cavity by snapping through the second guide slopes with the stop members inserted into the wells such that the first pivot frame is pivotable about the pins relative to the base plate;

the first and second pivots are matingly formed together such that the first and second pivot frames form a scissor-type resilient support;

the first pivot shaft is rotatably secured to the underside of the key cap; and the arms are rotatably secured to the underside of the key cap with the resilient member inserted through the second opening and the peg aligned with the stem.

2. The key of claim 1, wherein the first pivot is a hole and the second pivot is a pin.

3. The key of claim 1, wherein the base plate further comprises a rectangular support between the wells.

4. The key of claim 1, wherein the first pivot frame further comprises a positioning recess on the wall of the second opening.

5. The key of claim 1, wherein the resilient member is formed of silicon rubber and is shaped as a dome.

6. The key of claim 1, further comprising a panel with the membrane PCB mounted thereon.

* * * * *